US010932963B2

(12) United States Patent
Kenalty et al.

(10) Patent No.: US 10,932,963 B2
(45) Date of Patent: Mar. 2, 2021

(54) RAPID EVACUATION SLED FOR PATIENTS AND VICTIMS

(71) Applicants: Christopher Kenalty, Schomberg (CA); Miriam Gordon, Mississauga (CA)

(72) Inventors: Christopher Kenalty, Schomberg (CA); Miriam Gordon, Mississauga (CA)

( * ) Notice: Subject to any disclaimer, the term of this patent is extended or adjusted under 35 U.S.C. 154(b) by 471 days.

(21) Appl. No.: 15/392,792

(22) Filed: Dec. 28, 2016

(65) Prior Publication Data

US 2018/0177649 A1 Jun. 28, 2018

(51) Int. Cl.

| | |
|---|---|
| ***A61G 1/013*** | (2006.01) |
| ***A61G 1/02*** | (2006.01) |
| ***A61G 1/044*** | (2006.01) |
| ***A61G 1/048*** | (2006.01) |

(52) U.S. Cl.

CPC ..... *A61G 1/013* (2013.01); *A61G 1/02* (2013.01); *A61G 1/044* (2013.01); *A61G 1/048* (2013.01)

(58) Field of Classification Search

CPC ..... A61G 1/013; A61G 1/048; A61G 1/02; A61G 1/044; A61G 1/007; A61G 1/01; A61G 7/0504; A61G 7/1023; A61G 7/1026

See application file for complete search history.

(56) References Cited

U.S. PATENT DOCUMENTS 2,788,530 A * 4/1957 Ferguson ..... A61G 1/01 5/628
4,124,908 A * 11/1978 Burns ..... A61F 5/3776 2/69.5
4,566,445 A 1/1986 Jelsma et al.
4,601,075 A 7/1986 Smith
4,736,474 A 4/1988 Moran et al.
(Continued)

FOREIGN PATENT DOCUMENTS

DE 202012004581 U1 6/2012
WO 86/07253 A1 12/1986

OTHER PUBLICATIONS

Extended European Search Report dated Jul. 13, 2020, from European Patent Application No. 17888542.2.

*Primary Examiner* — David R Hare
*Assistant Examiner* — Alexis Felix Lopez
(74) *Attorney, Agent, or Firm* — Katten Muchin Rosenman LLP

(57) ABSTRACT

A patient evacuation sled has a bottom plastic sheet and a foam layer disposed thereabove. At least one spinal board is disposed between the bottom sheet and the foam layer, and a patient support plastic sheet is disposed above the foam layer. The bottom sheet, the foam layer, and the patient support sheet form a sandwiched portion configured to underlie a patient; peripheral edge portions of the bottom sheet and the patient support sheet are coupled together with substantially no foam layer therebetween. Plural horizontal straps are disposed substantially perpendicular to the longitudinal axis of the sled, and are coupled to the peripheral edge portions, and configured to, when tightened, at least partially enclose said patient in a cylindrically shaped cocoon. Plural wheel assemblies are coupled to each spinal board, at least a portion of each wheel assembly extends through corresponding holes in the bottom sheet.

18 Claims, 4 Drawing Sheets

(56) References Cited

U.S. PATENT DOCUMENTS 4,793,008 A 12/1988 Johansson
4,922,562 A 5/1990 Allred et al.
5,044,031 A 9/1991 Sherwood
5,050,254 A * 9/1991 Murphy ..... A61G 1/01 5/413 R
5,088,137 A 2/1992 Rose
5,189,746 A * 3/1993 Horie ..... A61G 1/01 5/627
5,386,604 A 2/1995 Ricketts
5,699,568 A * 12/1997 Couldridge ..... A61G 1/01 5/110
5,729,850 A * 3/1998 Eskeli ..... A61G 1/01 5/621
5,839,137 A * 11/1998 Butler ..... A61G 1/01 5/627
D421,413 S 3/2000 Calkin
6,363,936 B1 * 4/2002 McCormick ..... A61G 1/044 128/870
6,871,368 B2 * 3/2005 Calkin ..... A61G 1/01 5/625
6,948,203 B2 * 9/2005 Tsai ..... A45F 4/02 5/626
7,610,641 B2 * 11/2009 Frost ..... A61F 5/05825 277/625
7,614,103 B2 11/2009 Beaudry et al.
7,774,877 B2 * 8/2010 Kenalty ..... A61G 1/01 5/494
8,006,334 B2 8/2011 Kenalty et al.
8,122,543 B2 2/2012 Kenalty et al.
8,316,487 B2 11/2012 Kenalty et al.
8,365,326 B2 2/2013 Kenalty et al.
8,615,829 B2 12/2013 Kenalty et al.
8,672,842 B2 3/2014 Kenalty et al.
8,713,731 B2 5/2014 Kenalty et al.
8,793,827 B1 * 8/2014 Smart ..... A61G 1/044 128/870
8,881,327 B2 11/2014 Kenalty et al.
8,898,839 B2 12/2014 Kenalty et al.
8,938,828 B2 * 1/2015 Kenalty ..... A61G 1/01 5/625
9,668,908 B1 * 6/2017 Al-Azmi ..... A61F 5/3776
9,827,152 B1 * 11/2017 Calkin ..... A61G 1/044
2002/0162171 A1 11/2002 Faz
2007/0136950 A1 * 6/2007 Zuercher ..... A61G 1/01 5/627
2007/0180625 A1 8/2007 Walke et al.
2007/0278754 A1 12/2007 Walkingshaw
2008/0134436 A1 6/2008 Beaudry et al.
2008/0301876 A1 12/2008 Kenalty
2010/0005593 A1 1/2010 Bowling et al.
2010/0251479 A1 10/2010 Kenalty et al.
2010/0299836 A1 * 12/2010 Tanaka ..... A47C 31/08 5/626
2011/0177733 A1 7/2011 Grimes
2012/0053423 A1 3/2012 Kenalty et al.
2012/0151679 A1 * 6/2012 Kenalty ..... A61G 1/013 5/628
2013/0276235 A1 10/2013 Kenalty
2014/0053335 A1 * 2/2014 Calkin ..... A61G 1/044 5/628
2016/0151192 A1 * 6/2016 Slishman ..... A61F 5/05841 602/36

* cited by examiner

RAPID EVACUATION SLED FOR PATIENTS AND VICTIMS

BACKGROUND OF THE INVENTION

1. Technical Field

The present invention relates to a rapid evacuation device and method for patients and victims, and more particularly to a fold-up, wheeled, patient-enclosing sled for rapid evacuation during emergency and non-emergency situations. More particularly, the invention relates to such a compact device that folds up for stowage, but can be quickly deployed and used to evacuate an individual.

2. Background Art

Evacuation sleds are used by hospitals, assisted living facilities, emergency services, etc., to rapidly and safely evacuate patients from danger zones, such as flood areas, fires, explosions, etc., or to transport patients from one location to another. The patient is typically transferred from a bed into the r sled, lowered to the floor, and then evacuated by pulling or dragging a tow strap affixed to the sled. An efficient evacuation sled can be deployed and used by a single nurse or other caregiver. An evacuation mattress is disclosed in International Application Number PCT/NL 86/00015, published Dec. 18, 1986 under No. WO 86/07253, based on a Netherlands application filed Jun. 12, 1985. The mattress is characterized by belts or ropes to be put around the patient, which are permanently fastened to the sled. Such a mattress, while very useful, may be relatively expensive to buy, store, and maintain.

While many sled-type patient evacuation devices are known (such as the evacuation sled disclosed in U.S. Patent Publication No. 2007/0278754 to Walkingshaw), these sleds require several caregivers to transfer the patient into the sled for evacuation, and typically comprise one thin sheet of semi-flexible plastic. The sleds are then dragged through the hospital, down numerous flights of stairs, and then to an evacuation center where the patient waits (often for hours) for transportation to a hospital, where the patient must be removed from the sled and placed in a bed (again requiring several caregivers). This leads to problems such as contusions in the patient from being bounced down steps, patient hypothermia, and the necessity for many caregivers to perform the multiple patient-transfer steps.

Other known structures for evacuating non-ambulatory persons include boards or mats to support the patient. For example, U.S. Pat. No. 4,793,008 to Johansson discloses rigid mats with straps, respectively placed beneath the patient's chest and thighs. A relatively complicated Rescue Transportation Mattress is disclosed in U.S. Pat. No. 4,736,474 to Moran et al., wherein an inflatable support member and crossed straps are used to secure the person being transported. Again, such solutions do little for a quick, safe, and warm evacuation of a patient from a facility during an emergency.

A commercially successful evacuation sled is the Evacusled™. This is a tough plastic sheath, which surrounds the patient while the patient is still in his/her mattress. See, for example, U.S. Pat. No. 8,713,731. Wheels on the bottom provide enhanced mobility, and pull straps on front and back allow easy maneuvering. A drawback to this design is that the sheath must be positioned underneath the patient's mattress, and the entire mattress is evacuated together with the patient. See also, U.S. Pat. Nos. 8,938,828; 8,898,839; 8,881,327; 8,672,842; 8,615,829; 8,365,326; 8,316,487; 8,122,543; 8,006,334; and 7,774,877.

There are numerous other patents and patent applications employing rigid or semi-rigid supports and belts or straps to secure the person transported to the support. One apparent disadvantage to this use of straps or belts is that they could exert undue or excessive pressure on particular locations on the bodies of some evacuees, such as in the case of recent-surgery patients. Further, such sleds are often hard on the patient-support surface, and provide little cushioning to the patient as he/she is transported (often) over rough surfaces.

Thus, what is needed is an economical emergency evacuation sled for evacuating patients from hospitals, subways, homes, high rises, etc., that is capable of operation by a single care-giver, may be folded-up to fit within a compact space, provides a warm and secure cocoon for the patient, allows easy transport over any type of surface (e.g., up and down stairs), provides proper support for all of the patient's body, allows the patient to feel a high degree of comfort in what is otherwise a very stressful situation, and provides securing means (e.g., straps) to firmly hold the patient in place during transit.

SUMMARY

The present disclosure endeavors to provide an economical fold-up mattress for patients that overcomes certain of the problems noted above.

According to a first aspect of the present invention, a foldup patient-evacuation sled has a bottom sheet having a head end and a foot end. A foam mattress is disposed above the bottom sheet, and a patient support sheet is disposed above the mattress. The bottom sheet, the mattress, and the patient support sheet form a sandwiched bottom, a sandwiched left side, and a sandwiched right side. The sandwiched left side and the sandwiched right side are preferably dimensioned to respectively enclose at least portions of left and right sides of a patient lying on the sandwiched bottom. The bottom sheet and the patient support sheet preferably form a sandwiched margin left side and a sandwiched margin right side. A foot section is coupled to the bottom sheet and is dimensioned to substantially enclose the patient's feet and calves when the foot section is folded upward over the calves of the patient. The foot section is configured to fit beneath the sandwiched left side and the sandwiched right side when the patient is strapped within the sled. A plurality of spinal boards is disposed substantially perpendicular to a longitudinal axis of the sled, each spinal board being disposed above the bottom sheet and spaced apart from each other so that the sled may be folded in the direction of the longitudinal axis. The plurality of spinal boards is disposed more toward a head end of the sled than a foot end of the sled. At least one anti-wear surface is disposed on a bottom surface of the bottom sheet, the at least one anti-wear surface being disposed more toward the head end of the sled than the foot end of the sled. A plurality of wheel assemblies is mounted on each spinal board, each wheel assembly having a wheel portion extending through respective holes in the bottom sheet.

According to a second aspect of the present invention, a patient-evacuation sleds has a flexible bottom plastic sheet having a head end and a foot end. A foam mattress is disposed above the bottom sheet. A flexible plastic patient support sheet is disposed above the foam mattress. A semi-rigid plastic sheet is disposed below the bottom sheet. At least three spinal boards are disposed between the bottom sheet and the foam mattress, each spinal board extending in a direction substantially perpendicular to a longitudinal axis of the patient-evacuation mattress and having at least five wheel assemblies coupled to a bottom surface thereof. The bottom sheet and the semi-rigid plastic sheet each have at least one opening therein configured so that the spinal board wheel assemblies extend therethrough. The at least three spinal boards are disposed more toward the head end than the foot end of the bottom sheet. The bottom sheet and the patient support sheet are preferably sewn together around at least a majority of a periphery thereof, to form a margin zone, which has substantially no foam mattress between the bottom sheet and the patient support sheet. At least chest, waist, and knee straps are coupled to the margin zone and are disposed substantially perpendicular to a longitudinal axis of the sled. The chest, waist, and knee straps are configured to enclose a patient lying on the patient support surface such that at least a portion of the foam mattress encloses at least a portion of the patient.

According to a third aspect of the present invention, a patient evacuation sled has a bottom flexible plastic sheet, a foam layer disposed above the bottom sheet, and at least one rigid spinal board disposed between the bottom sheet and the foam layer. A patient support plastic sheet is disposed above the foam layer. The bottom sheet, the foam layer, and the patient support sheet form a sandwiched portion configured to underlie a patient lying on the patient support sheet. Peripheral edge portions of the bottom sheet and the patient support sheet are coupled together with substantially no foam layer therebetween. A plurality of substantially horizontal straps is disposed substantially perpendicular to a longitudinal axis of the sled, and is coupled to the peripheral edge portions, and configured to, when tightened, at least partially enclose said patient in a cylindrically shaped cocoon. A plurality of wheel assemblies is coupled to each of the at least one spinal boards, at least a portion of each wheel assembly extending through corresponding holes in the bottom sheet.

DETAILED DESCRIPTION OF THE PRESENTLY PREFERRED EXEMPLARY EMBODIMENTS

Figure 1:
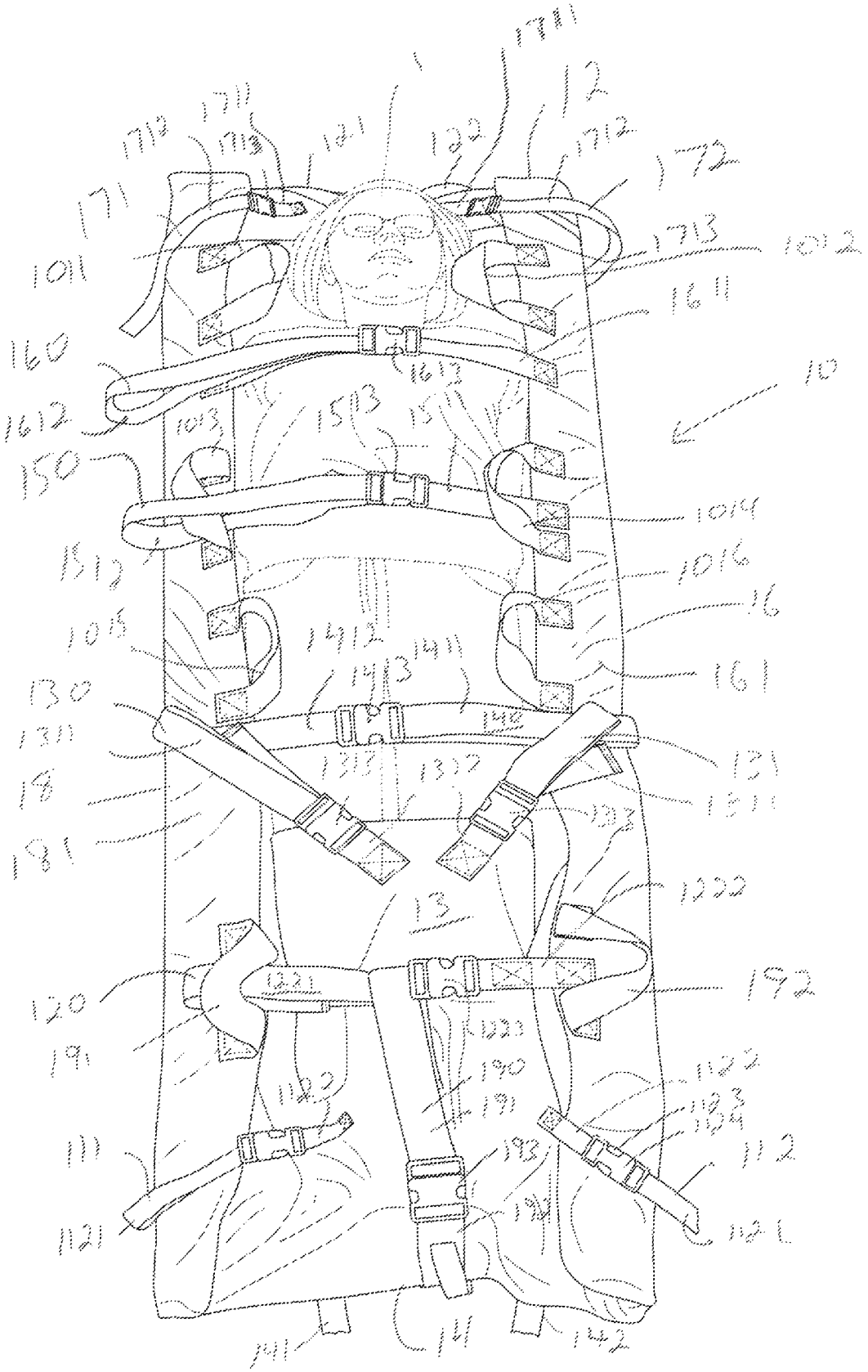
FIG. 1 is a front perspective view of a patient cocooned in the foldup patient evacuation sled according to a first embodiment of the present invention.

Preferred embodiments of the present invention will be described herein below with reference to the accompanying drawings. In the following description, well-known functions or constructions are not described in detail since they would obscure the invention in unnecessary detail.

As to nomenclature (and with reference to FIG. 1), each evacuation sled 10 has a "head" or "top" end 12 (where the head of a patient 1 will be positioned), a "foot" end 14, a "left" side 16 (when viewed from the supine patient's position), and a "right" side 18. With the patient 1 lying in the sled positioned on the ground, as in FIG. 1, "above" will refer to the direction in which the patient looks, and "below" will refer to the opposite direction. The mattress has a longitudinal axis from the head end 12 to the foot end 14. As can be seen, a portion 161 of the left side of the sled is configured to at least partially enclose the left side of the patient when the various straps are tightened. This provides a comforting cocoon for the patient in the sled, and also adds to the structural strength of the partially-cylindrically-shaped patient-and-sled combination. A portion 181 of the right side of the sled is also configured to enclose at least a portion of the patient in the sled similar to the portion 161. As will be described further below, at least a portion of the portions 161 and 181 will include foam mattress to further comfort and cushion the patient.

FIG. 1 is a front perspective view of the patient evacuation sled 10 according to a first embodiment of the present invention. The sled can be folded up in a direction of the longitudinal axis, generally in about three, four, or five folds. Preferably, the folded-up mattress is approximately 20-36 inches long, 20-36 inches wide, 3-6 inches thick, and weighs approximately 14-18 pounds. An optional label pouch may comprises a clear plastic envelope which may contain information such as patient information, mattress information, hospital information, or a blank sheet which may be used by triage personnel. The unfolded sled may be approximately 35.5 inches wide×80 inches long×1.5 inches thick, but may be larger or smaller depending on the size of the individual being carried. For example, in bariatric situations, the mattress my be substantially wider in order to accommodate the girth of the patient.

As will be described in more detail below with respect to FIG. 4, each sled has a bottom sheet 50 of flexible plastic (e.g., Vintex), a wear sheet 94 of semi-rigid PVC plastic disposed below at least a portion of the bottom sheet, and wheel assemblies 64 affixed to rigid (plastic or wood) spinal boards 60, 62, and 63. Above the spinal boards may be an intermediate sheet 92 of flexible or semi-flexible plastic. A foam mattress 90 is disposed above the spinal boards to support the patient in comfort and give some cushioning to the relatively hard surface of the spinal boards. Above the foam mattress is preferably a PVC stiffening layer 80*a*. A patient support flexible plastic sheet 80 is provided above the stiffening layer 80*a* and is the uppermost sheet upon which the patient will lie.

The sled 10 has numerous straps to both secure the patient in place and provide towing of the sled. For example, towing straps 141 and 142 are affixed (by sewing, and/or gluing, and/or heat welding, etc.) at the foot end and are preferably "T"-ed or "V"-ed to a single towing strap. In the preferred embodiment, the head strap is "T"-ed while the foot tow strap is "V"-ed. With these towing straps, a single caregiver can tow the patient and sled to safety, from either the head end or the foot end. The towing is made easier by the provision of the wheel assemblies on the bottom surface, as will be described in further detail below. Similar towing straps 121 and 122 are provided at the head end 12 where towing can be performed in conjunction with or in alternative to use of the straps 141 and 142.

Also at the foot end 14 are, preferably, angled foot end straps 111 and 112. Each strap has a strap portion 1121 and a connector portion 1122. Preferably, the strap portions are affixed to the bottom surface of the bottom sheet, while the connector portions are affixed to a top surface of a foot flap 13, which is affixed to the sled foot end 14 and folds upward over the feet and knees of the patient. When connected and tightened, these angled foot straps provide additional support to the patient and ensure that the corners of the sled-patient combination have no extended corners, which could catch on obstructions during an evacuation. While the preferred embodiment features click-together plastic connectors 1123 and 1124, any convenient means of connecting the strap portions, such a hook-and-fastener, Velcro, tying, may be adopted.

Above the angled foot straps is a horizontal knee strap 120, preferably comprising a strap portion 1221, a strap connector portion 1222, and a connector 1223 (similar to that described above). The knee strap preferably overlies the foot flap 13, and is preferably affixed to bottom surface of the bottom sheet at the left and right sides 16 and 18, at points between the ends of loop handles 191 and 192 (to be described further below). The knee strap 120, when connected together and tightened, further ads to the structural rigidity of the patient-sled combination. A vertical foot strap 190 has a strap connector portion 192 affixed to the foot end 14, a connector 193, and a strap portion 191 which is configured to loop up and around the knee strap 120. When connected and tightened, this vertical foot strap also enhances the integrity of the sled and minimizes any exposed parts during towing.

Above the horizontal knee strap 120 are two angled thigh straps 130 and 131. Like the above-described straps, each angled thigh strap comprises a strap portion 1311, a strap connector portion 1312, and a connector 1313. Preferably, the connector portions 1312 are affixed to the top surface of the foot flap 13 at a substantially forty-five degree angle with respect to the sled longitudinal axis. Of course, the angle may be varied from approximately fifteen degrees through approximately seventy-five degrees. Preferably, the strap portions 1311 are affixed to the bottom surface of the bottom sheet at the same angle as the strap connector portions. When connected and tightened, these angled thigh straps pull the foot flap 13 upward and outward, and ensure that the patient's thighs are fully covered and not exposed.

Also above the horizontal knee strap 120 is a horizontal thigh strap 140. Like the horizontal knee strap 120, it comprises a strap portion 1411, a strap connector portion 1412, and a connector 1413. Preferably, the strap portion 1411 is affixed to the bottom sheet at the left side 16, while the strap connector portion is affixed to the bottom sheet at the right side 18. When connected and tightened, the horizontal thigh strap 140 also pulls the sandwiched portion (the sandwich comprising the patient support sheet, the stiffening layer, the foam mattress, and the bottom sheet) of the left and right sides up and about at least a portion of the left and right sides of the patient. This tightening also adds to the structural rigidity of the patient-sled combination, and also brings the sandwiched cushioning upward from the bottom of the sled to cushion at least the patient's sides.

Above the horizontal knee strap 140 is, preferably, a horizontal waist strap 150. This waist strap comprises a strap portion 1511, a strap connector portion 1512, and a connector 1513. Preferably, the strap portion 1511 is affixed to the bottom sheet at the left side 16, while the strap connector portion 1512 is affixed to the bottom sheet at the right side 18. When connected and tightened, the horizontal waist strap 150 also pulls the sandwiched portion of the left and right sides up and about at least a portion of the left and right sides of the patient.

Above the horizontal waist strap 150 is, preferably, a horizontal chest strap 160. The chest strap 160 preferably comprises a strap portion 1611, a strap connector portion 1612, and a connector 1613. Preferably, the strap portion 1611 is affixed to the bottom sheet at the left side 16, while the strap connector portion 1612 is affixed to the bottom sheet at the right side 18. When connected and tightened, the horizontal chest strap 160 also pulls the sandwiched portion of the left and right sides up and about at least a portion of the left and right sides of the patient, and adds to the structural rigidity of the patient-sled combination.

Above the horizontal chest strap 160, and preferably also above the head of the patient, are two angled head straps 171 and 172. Each strap preferably comprises a strap portion 1711 affixed to an upper surface of the patient support sheet 80, a strap connector portion 1712 affixed to the bottom surface of the bottom sheet 50, and a connector 1713. Again, tightening these two angled head straps enhances structural integrity and keeps all portions of the patient and sled in one compact bundle.

Notable in the current embodiment is that the various straps are color coded to make connections/disconnections quick and easy. For example, the two angled foot straps and the vertical foot strap are preferably black; the horizontal knee strap is preferably green; the angled thigh straps are preferably green; the horizontal thigh strap is preferably yellow; the horizontal waist strap is preferably black; the horizontal chest strap is preferably orange; the angled head straps are preferably orange; the head and foot tow straps are preferably orange; and the loop handles are preferably red. The bottom sheet, the patient support sheet, and the anti-wear sheet are all preferably yellow. Of course, the color scheme(s) can vary, so long as a caregiver can quickly and easily strap/unstrap a patient in a high stress environment. Not also that it is possible to cross-connect the various straps to provide more secure fastening of patients of different dimensions. For example, small-dimensioned patients may benefit by cross-strapping one or more of the horizontal thigh strap, the horizontal waist strap, and the horizontal chest strap.

Also in FIG. 1 are shown head handles 1011 and 1012, chest handles 1013 and 1014, waist handles 1015 and 1016, and knee handles 191 and 192. Preferably, each handle is a loop handle with the ends thereof affixed to a bottom surface of the bottom sheet 50. As can be seen, the handles are preferably disposed more toward the head end than the foot end, to support the patient weight, which is typically similarly disposed.

Figure 2:
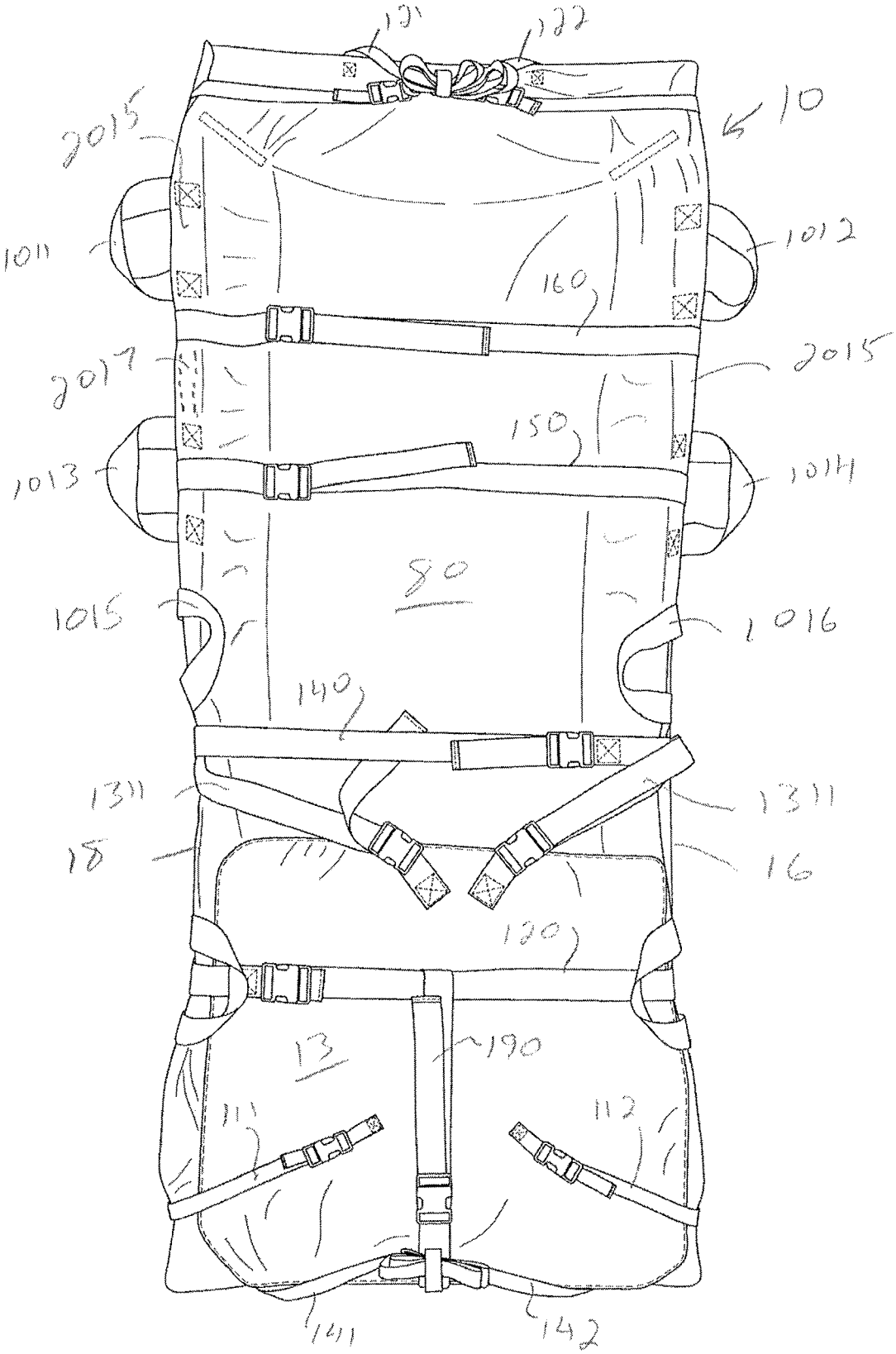
FIG. 2 is a front view of the FIG. 1 embodiment.

FIG. 2 shows a top view of the sled 10 without the patient, where the left and right sides 16 and 18 are opened. As can be seen, the patient support surface 80 extends all the way to the edges of the left and right sides. Notably, the foam mattress does not extend so far. In particular, as mentioned earlier, the "sandwich" portion comprises the patient support sheet 80, the stiffening layer 80*a*, the foam mattress 90, and the bottom sheet 50. This sandwich provides the comfort, protection, safety, and structural stability to the patient-sled. This sandwich portion underlies the patient and encompasses at least portions of the patient's left and right sides, as shown in FIG. 1. However, at peripheral portions of at least the left and right sides 16 and 18 is one or more margin sandwich portions (2015 in FIG. 2). In these margin portions, the sandwich comprises all except for the foam mattress. This gives a flatter surface on which to affix (e.g., stitch) the various straps and handles. In order to provide further structural rigidity to these margin portions, however, the preferred embodiment includes a reinforcing strap 2017 running longitudinally around the margin portions. Thus, the preferred margin sandwich portion also includes this reinforcing strap. In the preferred embodiments, this reinforcing strap, the handles, the horizontal and vertical straps all comprise nylon webbing similar in material and dimensions to that used in auto seat belts.

Figure 3:
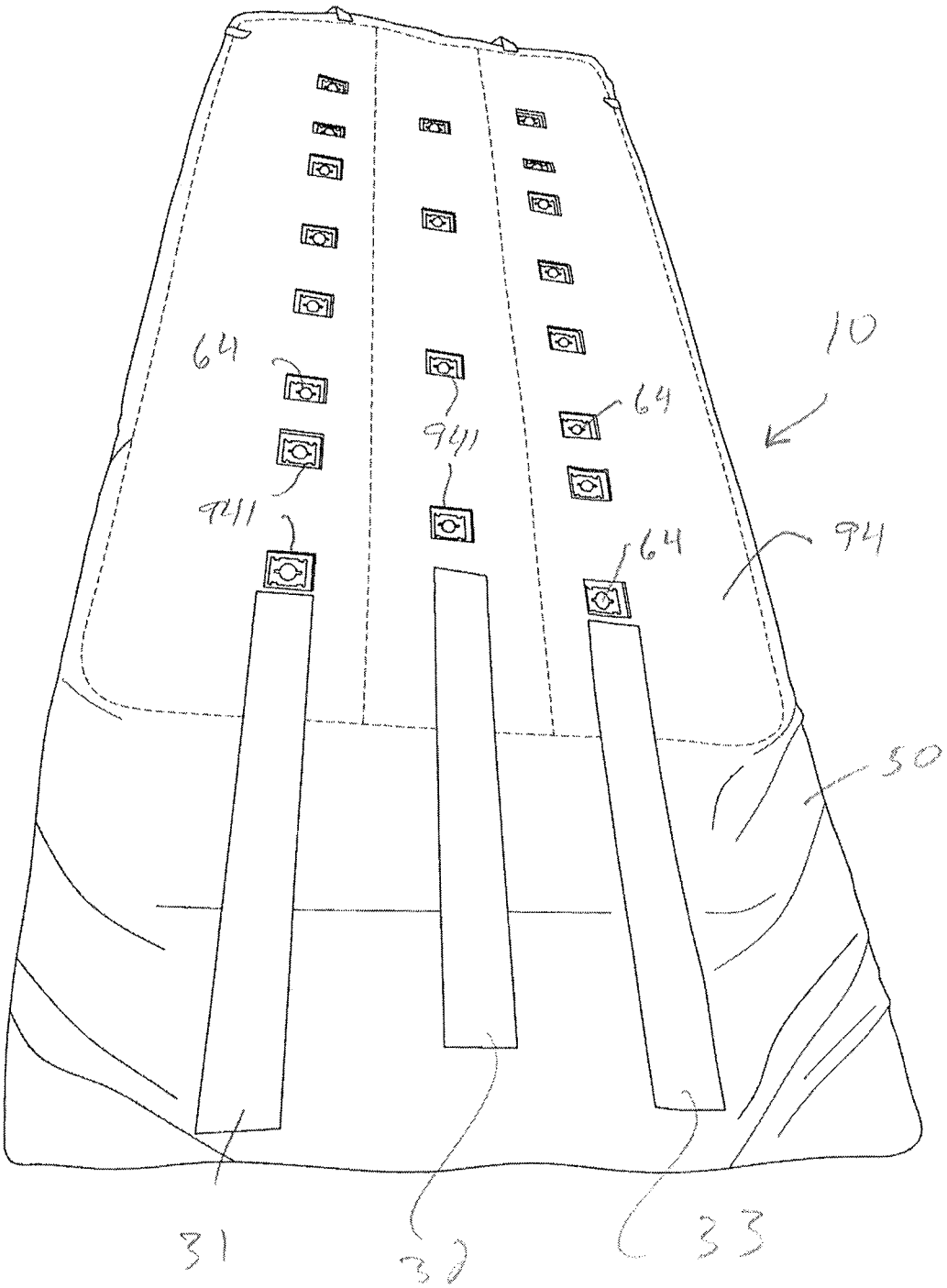
FIG. 3 is a bottom perspective view of the FIG. 1 embodiment.

FIG. 3 is a perspective bottom view of the sled 10 showing the bottom surface of the bottom sheet 50 and the PVC ant-wear sheet 94 affixed (e.g., stitched) thereto. This anti-wear sheet is semi-rigid PVD several centimeters thick, and adds durability to the bottom of the sled in instances where multiple evacuations or extended evacuations are needed. Notably, the openings 941 in the sheet 94 are not affixed to the bottom sheet adjacent these openings. This allows the ant-wear sheet 94 to offer flexibility (give and take in shear) as the sled is moved. Three optional ant-skid strips 31, 32, and 33 are also affixed to the bottom of the bottom sheet 50, in embodiments where a braking function may be desirable.

Figure 4:
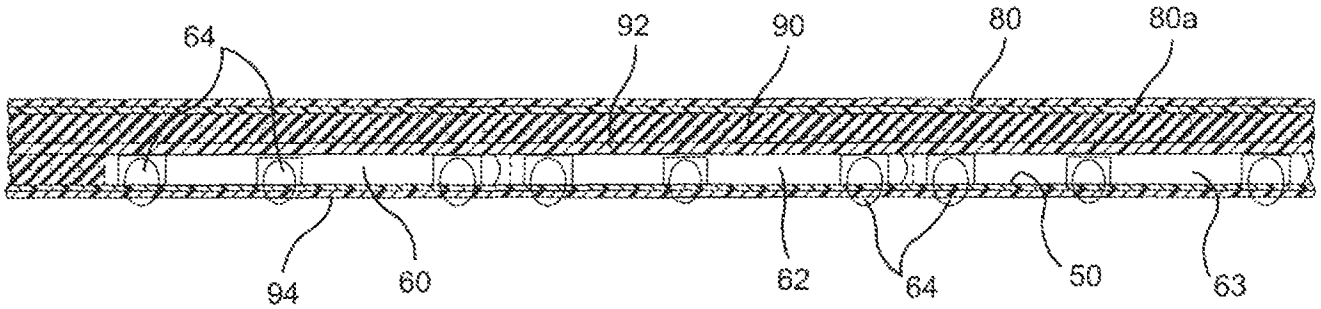
FIG. 4 is a cross-section of a portion of the FIG. 1 embodiment.

FIG. 4 has been described above. Note that it is a partial cross-section; in the preferred embodiment there are four spinal boards disposed substantially perpendicular to the sled longitudinal axis. In FIG. 4, the bottom sheet 50 is shown, with overlying, rigid spinal boards 60, 62, 63. Fixed to each spinal board are at least two (preferably five) wheel assemblies 64 which have wheel portions protruding through openings in the bottom sheet 50 and the anti-wear sheet 94. Preferably, fabric wear strips 31, 32, 33 can be affixed to the bottom sheet 50 and/or the anti-wear sheet 94, to protect the bottom sheet 50 when the mattress 10 is dragged along a surface. These wear strips may comprise Kevlar (which has an excellent co-efficient factor), ballistic nylon (which is a thick, tough, synthetic nylon fabric), or other suitable fabric.

In FIG. 4, the patient support sheet 80 preferably lies under the patient, and an optional second layer of SoffTICK™ 80*a* may be sewn, glued, stapled, and/or welded underneath the patient support sheet 80. Beneath this sheet is the foam mattress 90, which is used as a cushion and to conserve warmth for the patient. The foam mattress 90 may be ½ inch thick and be dimensioned slightly smaller than the patient support sheet 80. The foam material may comprise a fire-retardant, anti-fungal, open-cell material such as Vita B2721T1N urethane foam, available from Vitafoam Canada. Beneath the foam mattress 90 is, optionally, a reinforcing plastic sheet 92, preferably fixed to the foam mattress 90 by gluing, stapling, sewing, or welding. The reinforcing plastic sheet 92 preferably comprises two parallel sheets of rigid or semi-rigid plastic connected together by a series of orthogonal connecting walls running substantially perpendicular to the mattress longitudinal axis. A preferred reinforcing plastic sheet is Polyethylene Plastic which can be made by Modern Age Plastics Inc. of Toronto, Canada. The reinforcing plastic sheet 92 is preferably 1/16 to ½ inch thick, most preferably ⅛ inch thick, and dimensioned substantially to be ⅛ to ½ inches (preferably ¼ inches) wider/longer than the foam mattress 90. The reinforcing plastic sheet 92 provides structural stability to the foam mattress 90, and further shields the patient from the ground and the spinal boards. This sheet may be provided above and/or below the foam mattress.

The main role of the spinal boards 60, 62, 63 (and 64, not shown) is to provide additional support in the back and spinal regions. This support is particularly important when transporting an injured person (e.g., when lowering from a window, up or down a flight of stairs, etc.) because, not only will the person require additional back support, but the caregiver will require that the mattress stay somewhat planar when the person is being transported. The spinal boards provide substantial rigidity transverse to the longitudinal axis while the patient would provide needed rigidity to the longitudinal axis.

Also in FIG. 4, the spinal boards 60, 62, and 63 are shown disposed between the plastic reinforcing sheet 92 and the bottom sheet 50. Each spinal board is typically constructed from a plastic material (e.g., Polystyrene, PVC, Nylon, or other polymers, including high performance polymers) and has dimensions approximately 0.5×7.5×15.75 inches. While a 15.75 inch board is sufficient for a majority of people, in bariatric cases, the width may be increased to accommodate a larger body type. Alternately, the spinal boards may be placed side by side to increase the overall width. Preferably, the spinal board is a high density polyethylene or HDPE. A preferred plastic is made by Modern Age Plastics Inc., Canada.

Each spinal board may include a plurality (e.g., 3, 4, 5, or 6) of square openings, each approximately 1 inch×1 inch, where each is capable of receiving a wheel assembly 64 or other wheel structure. A wheel assembly 64 may be snapped, or clipped, into each square opening. Using replaceable wheel assemblies 64 that may be snapped into and out of the spinal board, as opposed to those that are permanently attached or integrated therein (which are also within the scope of the invention), allows for easy replacement should a wheel break or otherwise malfunction. This configuration also allows for interchanging the wheels for different sizes/weights/surfaces. Each wheel may be generally comprised of a single wheel within a housing, typically with an axle. The housing is configured to fit snugly within the square opening in the spinal board, and may include side pressure clips, which snap the wheel assembly in place once in the spinal board. However, it should be appreciated that the roll-up mattress is not limited to this type of wheel assembly. If the mattress is used in a snowy region, for example, it may be advantageous to completely omit casters all together and/or to use small skid plates.

In a preferred embodiment, little-to-none of the materials used to fabricate the spinal board would be metallic or any other material that may interfere with an X-ray machine. This is important because the foldup mattress 10 may stay with the patient even during X-ray procedures, particularly when the patient is in a delicate state and should not be moved until X-rays are complete. Suitable materials would include, for example, various plastics, Polystyrene, PVC, Nylon, or other polymers, including high performance polymers. Each spinal board preferably has plural wheel assemblies 64, which provide proper rolling support for the patient. Preferably, the plural wheel assemblies are respectively disposed along three axes substantially perpendicular to the mattress longitudinal axis. The wheel assemblies may comprise individual wheels mounted on individual axles, but may comprise cylindrical rollers extending all or part way across the length of the spinal board, and/or ball-bearings, and/or any known and convenient means to support the patient's movement along a surface. The most preferred embodiment has five individual wheel assemblies 64 fixed to the bottom of each spinal board, with one wheel assembly near each of the four corners of the spinal board, and one wheel assembly disposed substantially in the center of the spinal board.

Further in FIG. 4, the bottom sheet 50 has one or more holes or openings therein for the wheels to extend through so that the wheels contact the surface. In a preferred embodiment, a wheel bracket which holds the wheel axle is used to fix the spinal board to the bottom sheet 50. Beneath the bottom sheet 50 is, preferably, the anti-wear plastic sheet 94, which may be similar to the optional reinforcing plastic sheet 92, but serves not only to reinforce the structural integrity of the mattress 10, but serves as a skid/wear/slip plate to keep the bottom sheet 50 from being anti-wear reinforcing plastic sheet 94 has one or more opening therein so that the wheel assemblies 64 may be exposed to the surface, as shown schematically in FIG. 3. Each wheel assembly preferably comprises a wheel, axle, and bracket/housing, which are all preferably visible from the bottom of the mattress 10.

In the preferred embodiments, the patient support sheet 80 and the bottom sheet 50 are preferably constructed from a material that meets infection control measures, but may also contain microclimate features. In a preferred embodiment, the skin may be constructed from SoffTICK™ Standard Institutional Fabric Ultra 53-14, available from Vintex Inc. at www.vintex.com. Ultra 53-14 is advantageous because it is soft, flame retardant, durable, resistant to bacteria/fungal growth, self-deodorizing, hypo-allergenic, non-irritating and foam compatible, plastic sheet material. The entire bottom sheet 50 may be made from the Ultra 53-14 or from a more durable material. Suitable materials include, for example, Kevlar, or ballistic nylon, which may cover only a portion of the bottom sheet 50. Forming the entire lower sheet from a single durable material, although typically more expensive than regular skin, would eliminate the need to cut and bond a second material to the lower skin thereby reducing labor and some material costs.

An alternative solution to maintaining an anti-fugal and anti-bacterial mattress surface 80 may be to coat the mattress skin with spray-on liquid glass (also referred to as "$SiO_2$ ultra-thin layering"). Spray-on liquid glass is transparent, non-toxic, and can protect virtually any surface against almost any damage from hazards such as water, UV radiation, dirt, heat, and bacterial infections. Liquid glass coating is also flexible and breathable, making it suitable for use on both traditional mattresses and evacuation mattress (e.g., the roll up mattress).

The straps may be constructed from a strong fabric woven as flat strips and/or tubes. The flat type of material is more commonly known as webbing. The webbing may be woven from, for example, nylon, polypropylene, polyester, high-modulus polyethylene (e.g., Dyneema®), para-aramid synthetic fiber (e.g., Kevlar®), cotton, flax, and combinations thereof. While the webbing used to form the straps may be flat, for added strength, the webbing may partially encircle a core material, or be folded lengthwise around the core material. To seal the core material within the webbing, the edges of the webbing may be stitched, fused, or otherwise sealed along portions of the length of the strap portion or portions having a core, thereby preventing the core material from becoming disassociated with the webbing. The core material may be, for example, rope, hollow tube, cabling, etc. To the extent that communications or patient-monitoring electronics are incorporated into the evaluation mattress 10, wires, fiber optics, or other conductors may be embedded within the core (e.g., within a tube or conduit) to communicate signals from end to end.

The individual components shown in outline or designated by blocks in the attached Drawings are all well-known in the sled and mattress arts, and their specific construction and operation are not critical to the operation or best mode for carrying out the invention.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

All U.S. and foreign patent documents, all articles, brochures, and all other published documents discussed above are hereby incorporated by reference into the Detailed Description of the Preferred Embodiments.

What is claimed is:

1. A foldup patient-evacuation sled, comprising;

a bottom sheet having a head end and a foot end;

a foam mattress disposed above the bottom sheet;

a patient support sheet disposed above the mattress, wherein a stack comprising the bottom sheet, the foam mattress, and the patient support sheet forms a sandwiched left side and a sandwiched right side, and the sandwiched left side and the sandwiched right side are configured to respectively enclose at least portions of left and right sides of a patient lying on the patient support sheet, and wherein a margin stack comprising the bottom sheet and the patient support sheet forms a sandwiched margin left side and a sandwiched margin right side;

a foot section coupled to the bottom sheet and dimensioned to substantially enclose the patient's feet and calves when the foot section is folded upward over the calves of the patient, the foot section being configured to fit beneath the sandwiched left side and the sandwiched right side when the patient is strapped within the sled;

a left-side knee open-ended loop handle sewed to the sandwiched margin left side, and a right-side knee open-ended loop handle sewed to the sandwiched margin right side;

a left horizontal knee strap portion sewed to the sandwiched margin left side and in between open ends of the left-side knee open-ended loop handle;

a right horizontal knee strap portion sewed to the sandwiched margin right side and in between open ends of the right-side knee open-ended loop handle, wherein both of the left and right horizontal knee strap portions are affixed to a bottom surface of the bottom sheet and wherein the left and right horizontal knee strap portions are configured to overlie the foot section when the foot section is folded upward over the calves of the patient;

a plurality of spinal boards disposed substantially perpendicular to a longitudinal axis of the sled, each spinal board being disposed above the bottom sheet and spaced apart from each other so that the sled may be folded in the direction of the longitudinal axis, the plurality of spinal boards being disposed more toward a head end of the sled than a foot end of the sled;

at least one anti-wear surface disposed on the bottom surface of the bottom sheet, the at least one anti-wear surface being disposed more toward the head end of the sled than the foot end of the sled; and a plurality of wheel assemblies mounted on each spinal board, each wheel assembly having a wheel portion extending through respective holes in the bottom sheet.

2. The foldup sled according to claim 1, further comprising:

an angled left foot strap and an angled right foot strap, respectively coupled to lower portions of the sandwiched margin left side and the sandwiched margin right side, the angled foot straps being disposed at an acute angle with respect to the longitudinal axis of the sled; and an angled left foot strap connector portion and an angled right foot strap connector portion, respectively coupled to lower left and right sides of the foot section, the angled left foot strap connector portion and the angled right foot strap connector portion, respectively configured to couple with the angled left foot strap and the angled right foot strap.

3. The foldup sled according to claim 2, further comprising:

a horizontal thigh strap affixed respectively to the sandwiched margin right side and to the sandwiched margin left side;

an angled left thigh strap and an angled right thigh strap, respectively coupled to middle portions of the sandwiched margin left side and the sandwiched margin right side, respectively adjacent to where the horizontal thigh strap is affixed to the sandwiched margin right side and to the sandwiched margin left side the angled thigh straps being disposed at an acute angle with respect to the longitudinal axis of the sled; and an angled left thigh strap connector portion and an angled right thigh strap connector portion, respectively coupled to mid left and right sides of the sled, the angled left thigh strap connector portion and the angled right thigh strap connector portion, respectively configured to couple with the angled left thigh strap and the angled right thigh strap.

4. The foldup sled according to claim 3, further comprising:

an angled left head strap and an angled right head strap, respectively coupled to top portions of the sandwiched margin left side and the sandwiched margin right side, the angled head straps being disposed at an acute angle with respect to the longitudinal axis of the sled; and an angled left head strap connector portion and an angled right head strap connector portion, respectively coupled to top left and right sides of the sled, the angled left head strap connector portion and the angled right head strap connector portion, respectively configured to couple with the angled left head strap and the angled right head strap.

5. The foldup sled according to claim 4, wherein:

the angled left foot strap and the angled right foot strap and the angled left foot strap connector portion and the angled right foot strap connector portion are a first color;

the angled left thigh strap and the angled right thigh strap and the angled left thigh strap connector portion and the angled right thigh strap connector portion are a second color different from the first color; and the angled left head strap and the angled right head strap and the angled left head strap connector portion and the angled right head strap connector portion are a third color different from the first and second colors.

6. The foldup sled according to claim 5, wherein the horizontal thigh strap comprises a horizontal thigh strap connector portion, the horizontal thigh strap and the horizontal thigh strap connector portion being disposed at a substantially right angle with respect to the longitudinal axis of the sled.

7. The foldup sled according to claim 6, wherein the horizontal waist strap and the horizontal waist strap connector portion are a fourth color different from the first, second, and third colors.

8. The foldup sled according to claim 7, further comprising a horizontal chest strap and a horizontal chest strap connector portion, respectively coupled to mid portions of the sandwiched margin left side and the sandwiched margin right side, the horizontal chest strap and the horizontal chest strap connector portion being disposed at a substantially right angle with respect to the longitudinal axis of the sled.

9. The foldup sled according to claim 8, further comprising a vertical foot strap and a vertical foot strap connector portion, at least one of which is coupled to a bottom portion of the sled, the vertical foot strap and the vertical foot strap connector portion being disposed substantially parallel to the longitudinal axis of the sled, at least one of the vertical foot strap and the vertical foot strap connector portion being configured to loop over at least one of the horizontal knee strap and the horizontal knee strap connector portion.

10. The foldup sled according to claim 1, further comprising a plurality of left side open-ended loop handles sewed to the sandwiched margin left side, and a plurality right-side open-ended loop handle sewed to the sandwiched margin right side.

11. The foldup sled according to claim 10, wherein the left side open-ended loop handles and the right side open-ended loop handles are disposed more toward the head end of the sled than the foot end of the sled.

12. The foldup sled according to claim 1, wherein the at least one anti-wear surface comprises a plurality of openings through which the plurality of wheel assemblies respectively protrude.

13. The foldup sled according to claim 1, wherein the at least one anti-wear surface comprises a semi-rigid plastic which is more rigid than the bottom sheet.

14. The foldup sled according to claim 1, further comprising (i) a head towing strap coupled to the head end and (ii) a foot towing strap coupled to the foot end, each towing strap configured so that an ambulatory care-giver can tow a patient lying on said patient support sheet.

15. The foldup sled according to claim 1, wherein each of the plural spinal boards are articulatable with respect to each other about an axis substantially perpendicular to the longitudinal axis of the sled so that, when the bottom sheet, the mattress, and the patient support sheet are folded in the direction substantially parallel to a longitudinal axis of the sled, the spinal boards articulate with respect to each other.

16. The foldup sled according to claim 1, further comprising:

a left-side waist open-ended loop handle sewed to the sandwiched margin left side, and a right-side waist open-ended loop handle sewed to the sandwiched margin right side;

a left horizontal waist strap portion sewed to the sandwiched margin left side and in between open ends of the left-side waist open-ended loop handle; and a right horizontal waist strap portion sewed to the sandwiched margin right side and in between open ends of the right-side waist open-ended loop handle.

17. A patient-evacuation sled, comprising:

a flexible plastic bottom sheet having a head end and a foot end;

a foam mattress disposed above the bottom sheet;

a flexible plastic patient support sheet disposed above the foam mattress;

a semi-rigid plastic sheet disposed below the bottom sheet;

at least three spinal boards disposed between the bottom sheet and the foam mattress, each spinal board extending in a direction substantially perpendicular to a longitudinal axis of the patient-evacuation sled and having at least five wheel assemblies coupled to a bottom surface of the spinal board, the bottom sheet and the semi-rigid plastic sheet each having at least one opening therein configured so that the at least five spinal board wheel assemblies extend therethrough, the at least three spinal boards being disposed more toward the head end than the foot end of the bottom sheet;

the bottom sheet and the patient support sheet being sewn together around at least a majority of a periphery thereof, to form a margin zone which has substantially no foam mattress between the bottom sheet and the patient support sheet;

a foot section coupled to the bottom sheet and dimensioned to substantially enclose the patient's feet and calves when the foot section is folded upward over the calves of the patient;

at least chest, waist, and knee straps coupled to said margin zone and disposed substantially perpendicular to a longitudinal axis of the sled, wherein a stack comprising the bottom sheet, the foam mattress and the patient support sheet forms at least one sandwiched portion configured to enclose at least a portion of a patient lying on the patient support sheet, and said chest, waist, and knee straps are configured to overlie the patient; and a left-side knee open-ended loop handle sewed to a left margin zone, and a right-side knee open-ended loop handle sewed to a right margin zone;

a left horizontal knee strap portion sewed to the left margin zone in between open ends of the left-side knee open-ended loop handle; and a right horizontal knee strap portion sewed to the right margin zone in between open ends of the right-side knee open-ended loop handle, both of the horizontal knee strap portions being affixed to a bottom surface of the bottom sheet, the left and right horizontal knee strap portions overlying the foot section when the foot section is folded upward over the calves of the patient.

18. A patient evacuation sled, comprising:

a flexible plastic bottom sheet;

a foam layer disposed above the bottom sheet;

at least one rigid spinal board disposed between the bottom sheet and the foam layer;

a patient support plastic sheet disposed above the foam layer, wherein a stack comprising the bottom sheet, the foam layer, and the patient support sheet forms a sandwiched portion configured to enclose portions of a patient lying on the patient support sheet, and peripheral edge portions of the bottom sheet and the patient support sheet are coupled together to form a margin zone with substantially no foam layer therebetween;

a foot section coupled to the bottom sheet and dimensioned to substantially enclose the patient's feet and calves when the foot section is folded upward over the calves of the patient;

a plurality of substantially horizontal straps disposed substantially perpendicular to a longitudinal axis of the sled, and coupled to said margin zone, and configured to, when tightened, at least partially enclose said patient in a cylindrically shaped cocoon, the horizontal straps being affixed to a bottom surface of the bottom sheet, one of the horizontal straps overlying the foot section when the foot section is folded upward over the calves of the patient;

a left-side waist open-ended loop handle sewed to a peripheral edge left side, and a right-side waist open-ended loop handle sewed to a peripheral edge right side;

a left horizontal waist strap portion sewed to the peripheral edge left side and in between open ends of the left-side waist open-ended loop handle;

a right horizontal waist strap portion sewed to the peripheral edge right side and in between open ends of the right-side waist open-ended loop handle; and a plurality of wheel assemblies coupled to each of said at least one spinal boards, at least a portion of each said wheel assembly extending through corresponding holes in the bottom sheet.

* * * * *